United States Patent [19]

Street

[11] Patent Number: 4,905,387

[45] Date of Patent: Mar. 6, 1990

[54] ADJUSTABLE WHEEL FOR SNOW PLOW

[76] Inventor: Wayne L. Street, Rte. 2, Box 136, Paxton, Ill. 60957

[21] Appl. No.: 396,033

[22] Filed: Aug. 21, 1989

[51] Int. Cl.[4] ..... E01H 5/07

[52] U.S. Cl. ..... 37/271; 37/235; 37/270; 172/799.5; 254/102

[58] Field of Search ..... 37/235, 231, 232, 233, 37/234, 236, 271, 270, DIG. 11; 172/460, 473, 485, 504, 828, 799.5, 783; 254/424, 102, 100

[56] References Cited

U.S. PATENT DOCUMENTS

| | | | |
|---|---|---|---|
| 2,302,516 | 11/1942 | Ball | 37/232 |
| 2,428,131 | 9/1947 | Uebelhoer | 37/271 X |
| 2,862,315 | 12/1958 | Blanchet | 37/235 X |
| 3,466,766 | 9/1969 | Kahlbacher | 37/233 |
| 4,125,950 | 11/1978 | Mashford | 172/783 |
| 4,259,794 | 4/1981 | Rath | 37/233 |
| 4,537,262 | 8/1985 | van der Lely | 172/460 X |
| 4,567,627 | 2/1986 | Patterson et al. | 254/100 X |
| 4,827,637 | 5/1989 | Kahlbacher | 37/233 X |

*Primary Examiner*—Randolph A. Reese
*Assistant Examiner*—J. Russell McBee
*Attorney, Agent, or Firm*—Emrich & Dithmar

[57] ABSTRACT

A snow plow having a curved blade with a bottom scraping edge and rearwardly extending horizontally positioned mounting means. Two wheels each having a hub are each attached to a frame member with an outer cylindrical member having the bottom thereof connected to the associated wheel hub by a horizontally disposed strut and having the top thereof connected to the horizontally disposed strut by an angularly disposed strut. An inner cylindrical member is fixedly mounted to each of the mounting means for each wheel, the inner cylindrical members being adapted to fit inside of an associated one of the outer cylindrical members to mount the two wheels to the snow plow blade, and means providing vertical adjustment of the curved blade with respect to the wheel hub and the ground upon which the wheel rests.

13 Claims, 2 Drawing Sheets

ADJUSTABLE WHEEL FOR SNOW PLOW

BACKGROUND OF THE INVENTION

This invention relates to snow plow blades which can be mounted on powered vehicles for use during the Winter season and then removed for storage during the Spring, Summer and Fall, while the vehicle is used for other purposes. Typically, trucks such as garbage trucks and other multipurpose vehicles are used by many municipalities as dual functioning vehicles. At certain times of the year the trucks can be used to haul refuse, sand, gravel and the like, while at other times of the year, the trucks can be used to push snow plows to clear county and local highways and roads. The plows which are attached to these vehicles take a tremendous amount of abuse because the plows are used to clear vast amounts of snow and ice over rural roads and highways which may be in less than perfect repair. This results in the plows hitting ruts, boulders and other objects at speeds up to 20 or 25 miles per hour causing enormous forces and stresses to be generated and transmitted through the apparatus connecting the plow to the vehicle.

Heretofore, snow plows have been connected to support wheels therefor by means of square tubing connected to a pivot pin. The pivot pin stands upwardly from a frame which in the prior art has been mounted above the hub of the wheel in such a way that the forces generated when the snow plow hits the ground tends to tear the square tubing out of the rear of the snow plow and to bend the pivot connection between the snow plow and wheels used to transport the plow.

Because of the tremendous forces generated during snow plow operations, particularly when ramming the snow plow into large snow drifts, the connections between the snow plow and the frames having the wheels attached thereto tend to rip and twist requiring constant repair and replacement after relatively little use.

The present invention obviates the problems heretofore encountered by directing forces through a frame member which is substantially parallel to the wheel hub and may be axially co-planar with the hub. In any event, the wheel assembly which includes a mounting frame for the wheel is pivotally mounted to the rear of the plow in such a way that the forces generated when the plow hits either the ground or an obstruction while travelling at a high rate of speed or impacts into a snow drift or other object, is transmitted rearwardly through the frame to wheels and does not cause the twisting or other torque heretofore encountered which previously resulted in tearing and twisting of the frame mounting members particularly at the connections to the rear of the snow plow and to the pivot pin of the wheel assembly.

Accordingly, it is an object of the invention to provide a snow plow having an adjustable wheel comprising a curved blade portion having a bottom scraping edge and a mounting plate extending rearwardly from the rear surface of the plow, a wheel connected to the rear of the snow plow by a frame member, the frame member having horizontal strut means mounted at one end to the axle of the wheel and at the other end to the mounting plate extending from the rear of the plow, and means for vertically adjusting the plow with respect to the wheel axle.

It is another object of the present invention to provide a snow plow having a curved blade with a bottom scraping edge an rearwardly extending horizontally positioned mounting means, two wheels each having a hub, a frame member for each wheel including an outer cylindrical member having the bottom thereof connected to the associated wheel hub by a horizontally disposed strut and having the top thereof connected to the horizontally disposed strut by an angularly disposed strut, an inner cylindrical member fixedly mounted to the mounting means for each wheel, the inner cylindrical members being spaced apart along the longitudinal dimension of the snow plow blade each adapted to fit inside of an associated one of the outer cylindrical members to mount the two wheels to the snow plow blade, and means providing vertical adjustment of the curved blade and the bottom scraping edge with respect to the wheel hub and the ground upon which the wheel rests.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENT

Figure 1:
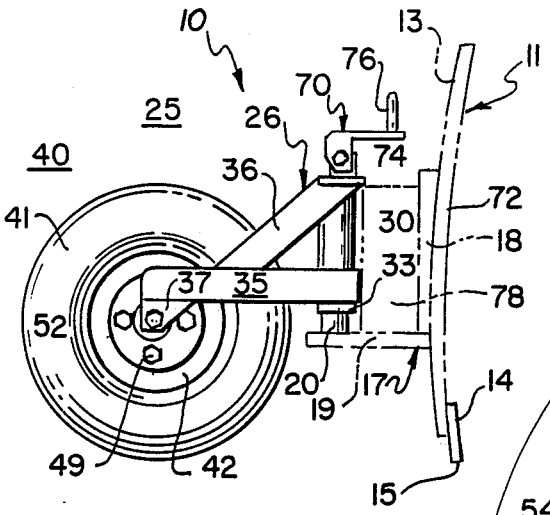
FIG. 1 is a side elevational view showing the wheel assembly connected to the rear of a plow.
Figure 1:
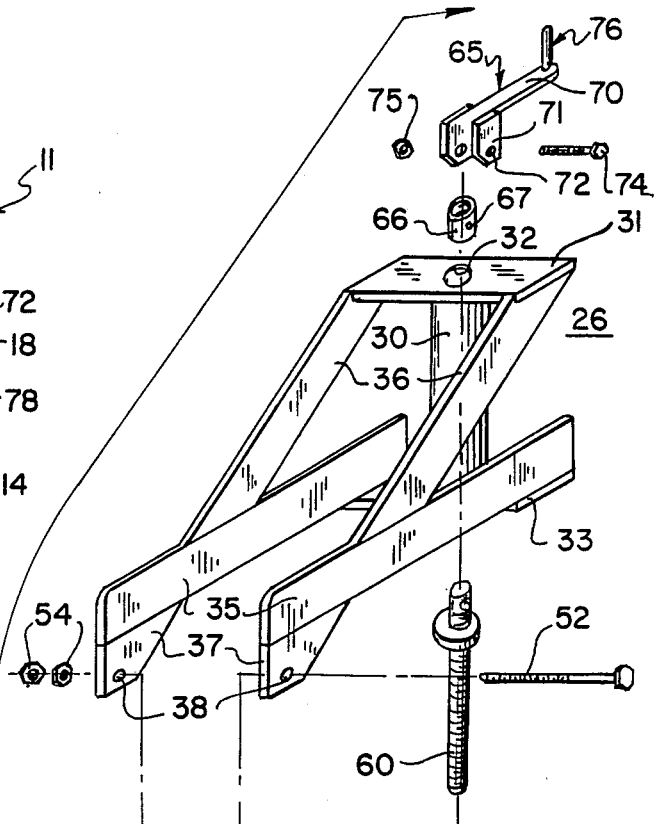
Figure 2:
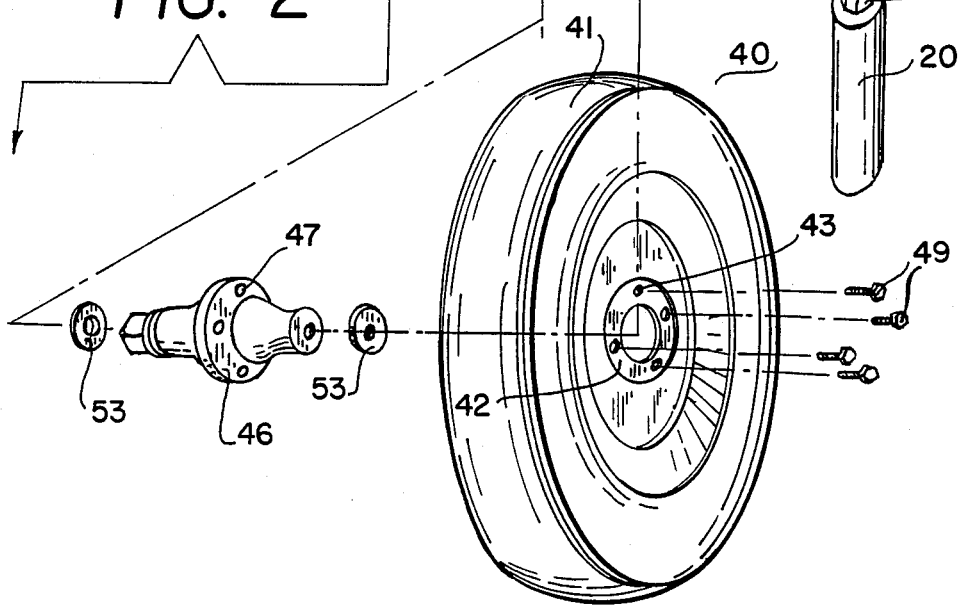
FIG. 2 is an exploded view of the wheel assembly showing the relationship among the wheel frame and the mounting mechanism to the plow and the relationship of the frame and the wheel hub.

Referring now to the drawings, there is illustrated a snow plow 10 which includes a blade 11 having a front curved surface 12 and a rear surface 13 generally parallel to the front surface 12. Fixedly mounted to the bottom of the snow plow blade 11 is a scraper 14 having a bottom surface 15 which in use rides along the highway. The scraper 14 may be bolted or welded to the blade 11, as is well known in the art. On the rear surface 13 of the blade 11 is a pair of spaced apart mounted plates 17 each having a vertical member 18 fixedly mounted to the rear of the snow plow blade 11 and a horizontally extending member or plate 19 which is integral with the vertical plate 18 and may either be made of one piece or be welded to the vertical plate 18. Generally, the mounted plates 17 are either integral with the snow plow blade or are welded thereto, but they may be bolted. An inner cylinder 20 is fixedly mounted onto the horizontal plate 19 of the mounting member 17 as by welding and extends upwardly therefrom and terminates in a hexagonal nut 21 at the top of the inner cylinder 20. The inner cylinder 20 has an internal thread, for a purpose hereinafter set forth.

Figure 3:
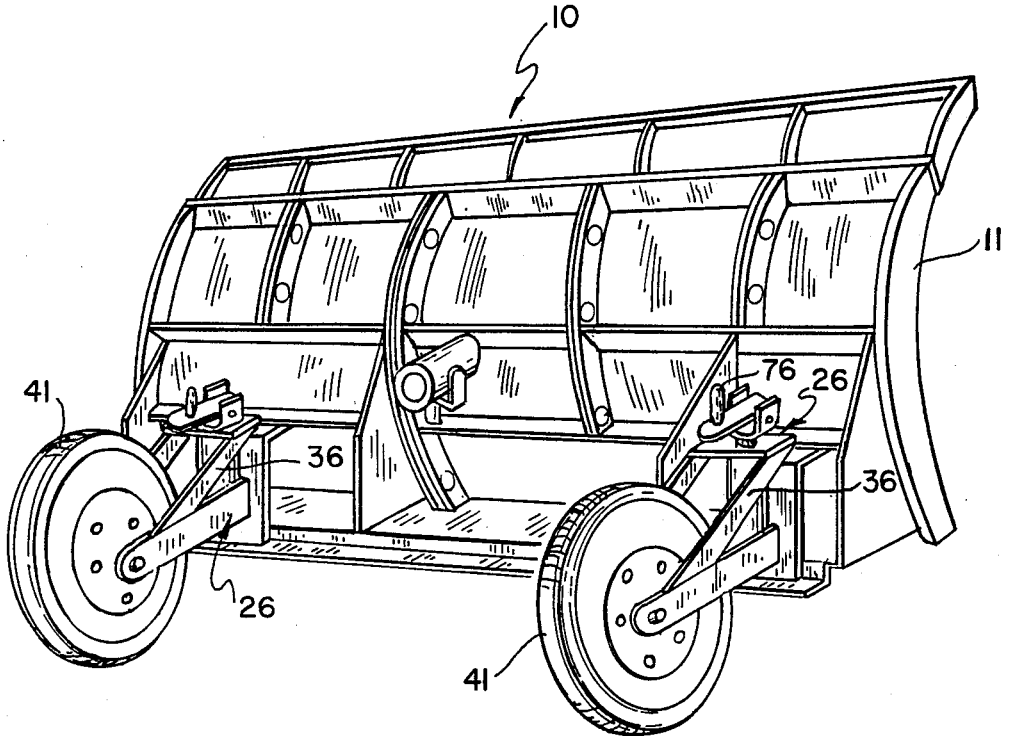
FIG. 3 is a perspective view of a snow plow having two wheel assemblies appropriately located and extending rearwardly of the snow plow.

A wheel assembly 25 includes a frame 26 which is connected, as will be described, to an outer cylinder 30 which is of a size to fit over the inner cylinder 20 so as to pivotally mount the wheel assembly 25 to the snow plow blade 11. The outer cylinder 30 has a top plate 31 having a central aperture 32 therein axially aligned with an opening in the cylinder 30 and a bottom plate 33 also having an axially aligned aperture, not shown. The frame 26 for each wheel assembly 25, and there are two such wheel assemblies 25, as shown in FIG. 3, further includes a pair of horizontal struts 35 each fixedly mounted as by welding to the bottom plate 33 and a pair of angular struts 36 having one end thereof welded to the top plate 31 and having the other end thereof welded to the associated horizontal strut 35. Each horizontal strut has a bottom tab portion 37 each of which has an axially aligned aperture 38.

A tire assembly 40 includes a standard pneumatic tire 41 mounted on a standard wheel rim 42 which is provided with a plurality of apertures 43 circumferentially spaced around the wheel rim 42. A hub 45 has a mounting surface 46 into which are drilled tapped holes 47 which are circumferentially spaced apart the same as the apertures 43 in the wheel rim so as to permit the wheel rim to be mounted to the wheel hub as by screws or lug bolts 49. The tire assembly 40 is mounted to the frame assembly 26 by means of a bolt 52 which extends through the two bottom tab portions 37 and the hub 45 and is provided with washers 53 and fasteners 54 as is well known in the art.

An externally threaded rod 60 is dimensioned to fit within and engage the internal threads of each of the two inner cylinders 20, each rod 60 having a washer 61 with a lateral extend greater than the aperture 32 and fixedly mounted thereto and a drilled hole 62 passing through the rod 60. Each rod 60 is threaded into the associated inner cylinder 20 and engages the associated top plate 31 closing the top of the outer cylinder 30 by contact between the washer 61 and the top plate 31 inside the outer cylinder 30; the rod 60 is mounted with the end of the rod having the hole 62 passing through the aperture 32 so that as each rod 60 moves up and down with respect to the associated cylinder 20 it carries with it top plate 31 of the associated frame assembly 26. A handle assembly 65 is provided each rod 60 and includes a collar 66 having apertures 67 drilled through opposed sides of the collar 66. A clevis member 70 having a pair of downwardly extending ears 71 with apertures 72 is mounted over the collar 66 which fits over the end of the associated rod 60 having the hole 62 therein so that a fastener 74 extending through the ears 71 of the clevis member 70 and through the hole 62 of the adjacent rod 60 serves to mount each handle 65 to the associated rod 60. A female fastener 75 ensures that each male fastener 74 is maintained in place and a handle 76 extends upwardly from the clevis member 70 to permit easy rotation of the rod 60 with respect to the fixed inner cylinder 20, thereby causing the frame 26 to move upwardly and downwardly with respect to the blade 11 and particularly results in vertical adjustment of the scraper 14 and the bottom surface 15 thereof with respect to the roadway. Finally, a butt plate 78 shown in dotted line in FIG. 1 serves to limit rotation movement of the wheel assembly 26 with respect to the plow blade 11 by physically interfering with the frame 26 when it is rotated out of the plane of the paper as seen in FIG. 1.

As can be seen from the drawings, a snow plow 10 consisting of a blade 11 mounted on a pair of wheel assemblies 25 can be attached to a hydraulic hoist on the front end of a vehicle and propelled down the road to maintain roads during winter conditions. As will be understood by those skilled in the art, the hydraulic front end of the vehicle will make gross vertical adjustments of the snow plow 10 and particularly the blade with respect to an upward or travelling position and a downward use or scrapping position. Minor adjustments in the vertical position of the scraper 14 with respect to the road surface are made with the vertical adjustment and handle assemblies 65 on the two wheel assemblies 25. The vertical adjustments obtained by rotation of the handles 65 are on the order of an inch or two, but this is sufficient to accommodate for variations in snow packing and the underlying conditions of the ground.

In practice, the cylindrical mounting mechanism of the present invention which includes for each wheel assembly 25, the inner cylinder 20 and the outer cylinder 30 in combination with the frame 26 which provides for, it is believed, transmission of forces from the blade 11 directly along the struts 35 and 36 to the wheel hub 45 has resulted in a mechanism which lasts much longer in the field without the usual destruction of the connecting mechanism by ripping the struts and tearing the rectangular tubing used in the prior art structure.

In another version of the invention, the horizontal struts 35 lie along the same plane as the wheel axis and the bolt 52.

While there has been disclosed what is considered to be the preferred embodiment of the present invention, it is understood that various changes in the details may be made without departing from the spirit, or sacrificing any of the advantages of the present invention.

I claim:

1. A snow plow having an adjustable wheel comprising a curved blade portion having a bottom scraping edge and a mounting plate extending rearwardly from the rear surface of said plow, a wheel connected to the rear of said snow plow by a frame member, said frame member having horizontal strut means mounted at one end to the axle of said wheel and at the other end to said mounting plate extending from the rear of said plow, and means for vertically adjusting said plow with respect to said wheel axle, said frame member further including upper and lower plates each having an axially aligned aperture therein; an outer cylinder mounted between and connected to said upper and lower plates, said horizontal strut means is a pair of horizontal struts interconnecting said lower plate with the hub of the associated wheel, an inner cylinder fixedly mounted on said mounting plate to fit within said outer cylinder to mount said wheel and frame member to said plow.

2. The snow plow of claim 1, wherein each horizontal strut is connected to said top plate by a diagonally extending strut connecting said top plate to the associated horizontal strut.

3. The snow plow of claim 2 wherein each of said diagonal struts intersects the associated horizontal strut between the ends of said horizontal strut.

4. The snow plow of claim 3, wherein said horizontal struts are positioned in a plane above the horizontal plane passing through said wheel hub.

5. The snow plow of claim 4, wherein each horizontal strut has at the end thereof connected to the wheel hub a downwardly extending tab having an aperture therein through which rod means mounts said frame member to said wheel hub.

6. The snow plow of claim 1, wherein said inner cylinder is threaded and further comprising means associated therewith for vertically adjusting said plow blade portion with respect to said wheel.

7. The snow plow of claim 6, wherein said inner cylinder is internally threaded and externally threaded rod means is in engagement with the internal threads of said inner cylinder, stop means is mounted on said rod means to cause said frame member to move vertically with said stop means, whereby rotation of said rod means with respect to said inner cylinder causes said rod means and said stop means carried thereby to move vertically thereby moving said frame member.

8. A snow plow having a curved blade having a longitudinal dimension with a bottom scraping edge and rearwardly extending horizontally positioned mounting means, two wheels each having a hub, a frame member for each wheel including an outer cylindrical member having the bottom thereof connected to the associated wheel hub by a horizontally disposed strut and having the top thereof connected to the horizontally disposed strut by an angularly disposed strut, an inner cylindrical member fixedly mounted to said mounting means for each wheel, said inner cylindrical members being spaced apart along the longitudinal dimension of said snow plow blade each adapted to fit inside of an associated one of said outer cylindrical members to mount said two wheels to said snow plow blade, and means providing vertical adjustment of said curved blade and said bottom scraping edge with respect to said wheel hub and the ground upon which said wheel rests.

9. The snow plow of claim 8, wherein each wheel frame member includes top and bottom plates fixedly mounted to said outer cylindrical member, said top and bottom plates each having an aperture therein axially aligned with an opening in said outer cylindrical member, each of said frame members having spaced horizontal struts extending from said bottom plate to said wheel hub and being connected to said wheel hub by bolt means, said top plate being connected to each horizontal strut by a straight angularly disposed strut.

10. The snow plow of claim 9, wherein said inner cylindrical member is internally threaded and an externally threaded rod is dimensioned to fit within said inner cylindrical member and engage said threads, said rod passing axially through said outer cylindrical member and through said top plate, and means on said rod engaging said top plate, whereby rotation of said rod vertically adjusts said mounting plate and said plow with respect to said wheel hub.

11. The snow plow of claim 10, wherein said means on said rod engaging said outer cylinder is an annular washer fixedly positioned on said rod having a lateral extent greater than the aperture in said top plate, said annular flange engaging said top plate inside said outer cylinder such that rotation of said rod causes said top plate to move vertically permitting adjustment of said plow with respect to said wheels.

12. The snow plow of claim 10 and further comprising crank means on said rod for assisting rotation of said rod in said inner cylinder member.

13. The snow plow of claim 12, wherein said crank means has a clevis having spaced ears on a rod-engaging end thereof, each ear of said clevis having an aperture therein and a pin extending through said apertures in said clevis ears and an aligned aperture in said rod connects said crank means to said rod.

* * * * *